United States Patent [19]

Davis

[11] 4,146,138

[45] Mar. 27, 1979

[54] CLAMP ON MAGAZINE RACK

[76] Inventor: Dale W. Davis, 3310 Erie St., Youngstown, Ohio 44507

[21] Appl. No.: 870,480

[22] Filed: Jan. 18, 1978

[51] Int. Cl.[2] ..... A47F 5/01

[52] U.S. Cl. ..... 211/86; 211/106; 220/404; 220/410; 248/226.4

[58] Field of Search ..... 211/42, 50, 51, 55, 211/86, 87, 106, 88, 90; 220/403, 404, 410; 248/225.3, 226.1, 226.3, 226.4

[56] References Cited

U.S. PATENT DOCUMENTS

| | | | |
|---|---|---|---|
| 1,878,850 | 9/1932 | Hilgers | 248/226.4 X |
| 1,946,967 | 2/1934 | Douglas | 248/226.4 |
| 2,807,371 | 9/1957 | Johnson | 211/88 |
| 2,885,088 | 5/1959 | Miskin | 211/87 |
| 2,925,916 | 2/1960 | Pollock | 211/86 |
| 3,396,885 | 8/1968 | Giondi | 220/404 X |
| 3,927,768 | 12/1975 | Cohen | 211/106 X |
| 4,040,522 | 8/1977 | Vickery | 211/88 |
| 4,083,392 | 4/1978 | Kobayshi | 220/404 X |

FOREIGN PATENT DOCUMENTS

| | | | |
|---|---|---|---|
| 403559 | 6/1966 | Switzerland | 248/226.4 |
| 886952 | 1/1962 | United Kingdom | 211/88 |

*Primary Examiner*—Roy D. Frazier
*Assistant Examiner*—Robert W. Gibson, Jr.
*Attorney, Agent, or Firm*—Webster B. Harpman

[57] ABSTRACT

A magazine rack has a receptacle with an open top portion and a pair of vertical support members secured thereto which extend therebelow together with a pair of U-shaped friction clamps engagable over the bottom of a door and provided with tensioning members for clamping the vertical support members and the receptacle to a portion of the door thereabove.

5 Claims, 4 Drawing Figures

CLAMP ON MAGAZINE RACK

BACKGROUND OF THE INVENTION

1. Field of the Invention

This invention relates to magazine racks which can be temporarily or removably affixed to supporting surfaces such as doors.

2. Description of the Prior Art

Prior structures of this type may be seen in U.S. Pat. No. 1,738,821 wherein several vertically arranged receptacles are attached to a door by conventional fasteners such as screws. U.S. Pat. No. 2,885,088 discloses a receptacle for telephone directories, the receptacle is attachable to a vertical supporting surface by conventional fasteners and additional receptacles may be secured thereto. The clamp on magazine rack of the present disclosure provides a simple, inexpensive receptacle with a pair of verticle support members forming a part thereof and extending below the bottom portion of the receptacle. U-shaped clamps engagable upwardly over the lower portion of a door and clampingly engaged against the lower portions of the vertical support members secure the device to the door. The arrangement of the vertical support members is such that they are stressed when clamped to the door so as to create a tensioned engagement with the door which holds the receptacle in desirable position relative thereto. The invention does not require the use of fasteners engaging the door and thus avoids damaging the same.

SUMMARY OF THE INVENTION

A magazine rack for clamp on attachment to a door comprises a receptacle open at its upper end and having a pair of vertical support members on one side thereof, portions of which extend below the receptacle. U-shaped clamps engaged over the bottom of the door clampingly secure the vertical support members to the door and the U-shaped support members are stressed or tensioned as by forming the same with a slight bow so that the receptacle forming the rack is urged against the door by the distortion of the vertical support members when they are clamped to the door. A vinyl liner including downwardly extending front and back sections may be positioned in the receptacle with one of the sections positioned between the magazine rack and the door and the other one forming a front cover-like section.

DESCRIPTION OF THE PREFERRED EMBODIMENT

Figure 1:
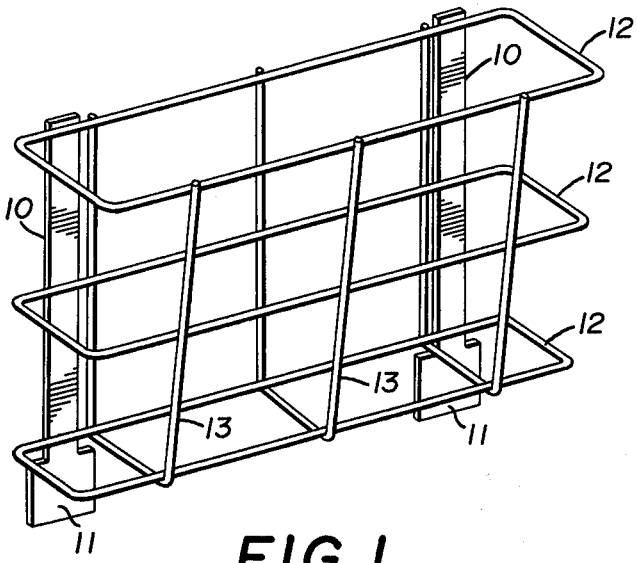
FIG. 1 is a perspective view of the clamp on magazine rack.

In its preferred form the clamp on magazine rack, as may be seen in FIG. 1 of the drawings, comprises a pair of horizontally spaced vertical support member 10, each of which has an enlarged lower end portion 11. The vertical support members are preferably slightly bowed rather than being straight longitudinally and their slightly convex surfaces are attached to a plurality of vertically spaced rectangular frames 12, each of which are horizontally disposed. The frames 12 and the vertical support members 10 are preferably steel and the attachments of these parts may be by welding. In order that the receptacle thus formed will have a suitable bottom portion for supporting magazines positioned therein, a plurality of U-shaped secondary frames 13 are positioned vertically in horizontally spaced relation to one another and attached to the several frames 12 as by welding. The entire receptacle thus formed, as seen in FIG. 1 of the drawings, may be provided with an enveloping coating of finishing material such as a suitable synthetic resin.

Figure 3:
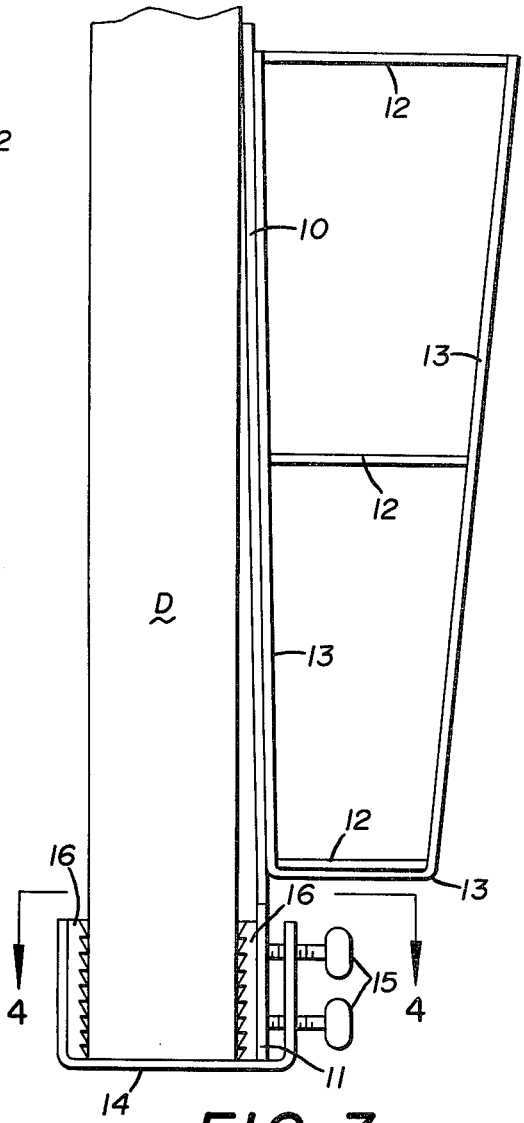
FIG. 3 is an edge view of a portion of a door showing the magazine rack clamped thereto.
Figure 2:
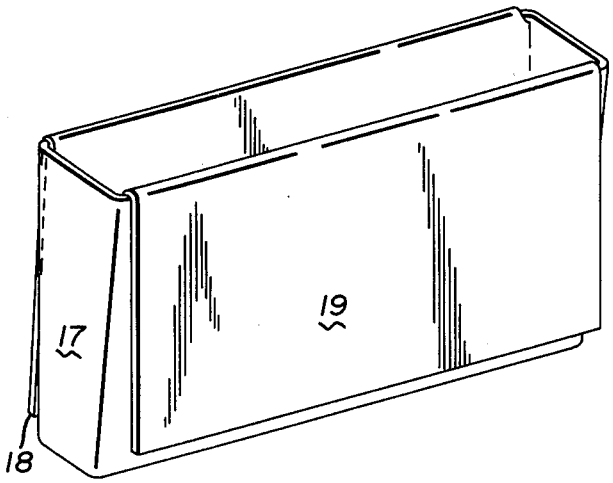
FIG. 2 is a perspective view of a vinyl liner for positioning in the rack of FIG. 1.

By referring now to FIG. 3 of the drawings, it will be seen that the magazine rack is shown positioned on and secured to a lower portion of a door D through the use of a pair of U-shaped clamps 14. Thumb screws 15 are positioned through threaded openings in each of the U-shaped clamps 14 for engagement with the enlarged lower end portions 11 of the vertical support members 10 and resilient pads 16, preferably serrated, are positioned against the surfaces of the door D and adjacent a portion of each of the clamps 14 and the inner surface of the enlarged lower end portions 11 of the vertical support members.

Figure 4:
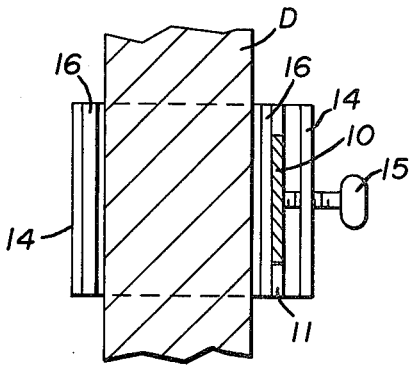
FIG. 4 is a horizontal section on line 4—4 of FIG. 3.

FIG. 4 of the drawings is a horizontal section on line 4—4 of FIG. 3 and by referring thereto it will be seen that the resilient pads 16 as also seen in FIG. 3 of the drawings act to space the enlarged lower end portions 11 of the vertical support members 10 slightly outwardly with respect to the vertical surface of the door D against which the magazine rack is positioned. As the vertical support members 10 are bowed slightly in untensioned state they will assume a longitudinal straight pattern when clamped to the door as seen in FIGS. 3 and 4 and the distortion of the vertical support members 10 will thus hold the frames 12 and the U-shaped members 13 securely against the surface of the door D.

The magazine rack may be used as thus disclosed or it is preferably provided with a vinyl liner in the form of a pocket shaped member 17 which is provided with front and back flaps 18 and 19. When the liner 17 is positioned in the receptacle, the flaps 18 and 19 may extend down the back and front portions thereof, the back flap serving as a cushioning agent between the vertical support members 10 and the surface of the door and the front flap 19 serving as an attractive cover.

It will thus be seen that a clamp on magazine rack has been disclosed which is economically formed, light in weight and is capable of holding a number of magazines in a desirable location on a door when the same is clamped thereto.

Although but one embodiment of the present invention has been illustrated and described, it will be apparent to those skilled in the art that various changes and modifications may be made therein without departing from the spirit of the invention and having thus described my invention what I claim is:

1. A clamp on magazine rack for a door and comprising a receptacle having an open upper portion and at least one vertically positioned bowed support member secured to said receptacle and extending therebelow, means spacing the lower end of said support member with respect to said door, said support member arranged with its convex surface towards said receptacle and at least one U-shaped member for positioning on the bottom of the door with vertical portions on either side of the door and clamping means on one of said vertical portions of said U-shaped member for urging said spaced lower end of said bowed support member toward said door whereby the upper end of said bowed support member is firmly engaged against said door by the distortion of the bowed support member.

2. The clamp on magazine rack set forth in claim 1 and wherein said means spacing said support member with respect to said door comprises a resilient pad positioned between said support member and said door.

3. The clamp on magazine rack set forth in claim 1 and wherein the clamping means comprises thumb screws threadably engaging said vertical portions of the U-shaped member and arranged for registry with the lower portions of said vertical support member whereby the same may be moved toward the door surface.

4. The clamp on magazine rack of claim 1 and wherein the receptacle is formed of wire members including horizontally disposed rectangular frames and vertically positioned U-shaped members secured thereto, said rectangular shaped frames being secured to said vertical support member.

5. The clamp on magazine rack set forth in claim 1 and wherein a second resilient pad is positioned on the inner surface of the U-shaped member for registry with one surface of said door and said first mentioned resilient pad is positioned on the lower end of said vertical support member for engagement against the opposite side of said door.

* * * * *